United States Patent [19]
Pastine
[11] 4,325,305
[45] Apr. 20, 1982

[54] ELECTRICAL AUGMENTATION OF DETONATION WAVE

[75] Inventor: Donald J. Pastine, Highland, Md.

[73] Assignee: The United States of America as represented by the Secretary of the Navy, Washington, D.C.

[21] Appl. No.: 169,577

[22] Filed: Jul. 17, 1980

[51] Int. Cl.³ ..... F42C 19/00
[52] U.S. Cl. ..... 102/201; 102/305; 102/701
[58] Field of Search ..... 102/201, 209, 305, 701

[56] References Cited

U.S. PATENT DOCUMENTS 3,392,527 7/1968 Gilmour, Jr. et al. .
3,724,383 4/1973 Gallaghan et al. ..... 102/201
4,047,483 9/1977 Williams ..... 102/201 X

OTHER PUBLICATIONS

Yang et al., Detonation of Insensitive High Explosives by a Q-Switched Ruby Laser, App. Physics Letters, vol. 19, #11 , 12-1971, pp. 473-475.

*Primary Examiner*—Peter A. Nelson
*Attorney, Agent, or Firm*—R. S. Sciascia; A. L. Branning; W. R. Henderson

[57] ABSTRACT

A method and apparatus for electrical augmentation of steady state detonation waves in solid or fluid explosives. Two electrical conductors are disposed along opposed margins of explosive material and coupled across a source of electrical energy. When the explosive material is detonated and as the detonation wave propagates along the explosive material, electrical energy is furnished across the conductors and into the detonation wave which is more conductive than either the undetonated explosive or detonation product gases. The electrical energy coupled into the detonation wave adds energy over and above that which is normally delivered chemically and thus causes the detonation pressure and velocity to increase and therefore increases the ability of the explosive material to accelerate objects and do work.

15 Claims, 2 Drawing Figures

ELECTRICAL AUGMENTATION OF DETONATION WAVE

BACKGROUND OF THE INVENTION

Normally, the velocity and pressure in a detonation wave and the total work accomplishable by hot, explosive product gases are determined by the chemical energy available for release in an explosive or energetic material. Augmentation of this chemical energy in the explosive material results in more available energy for increasing the velocity and pressure of the detonation wave and therefore increasing the ability of the explosive material to accelerate objects and do work.

SUMMARY OF THE INVENTION

Accordingly, there is provided in the present invention a method and apparatus for electrical augmentation of steady state detonation waves in solid or fluid explosives. Two electrical conductors are disposed along opposed margins of explosive material and coupled across a source of electrical energy. The electrical energy can be provided by electrical generators, electrical pulsers or explosively driven electrical sources.

When the explosive material is detonated and as the detonation wave propagates along the explosive material, electrical energy is furnished across the conductors and into the detonation wave which is more conductive than either the undetonated explosive or the detonation product gases. The electrical energy coupled into the detonation wave adds energy over and above that which is normally delivered chemically and thus causes the pressure and velocity of the detonation wave to increase.

OBJECTS OF THE INVENTION

It is an object of the present invention to augment the chemical energy produced by detonation of an explosive charge.

Another object is to increase the velocity and pressure of a detonation wave passing through an explosive charge.

Yet another object of the invention is to accelerate a detonation wave in an explosive charge beyond the chemical capabilities of the charge.

A still further object is to produce exceedingly larger power pulses by sequentially feeding the electrical output of explosively driven pulse power generators into the detonation waves of other generators.

Other objects, advantages and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENT

Figure 1:
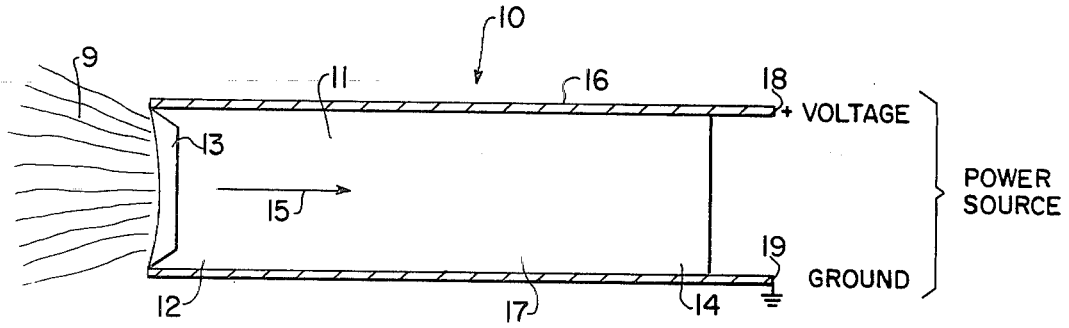
FIG. 1 shows a schematic illustration of the apparatus for augmenting the detonation wave.

Referring to FIG. 1 there is shown a schematic illustration of the augmentation apparatus 10 of the subject invention. A ribbon of explosive 11 which can be any suitable explosive composition is detonated at first end 12 by a detonator (not shown) and is thus furnished with a steady state detonation wave 13 producing product gases 9. The detonation wave propagates from first end 12 to second end 14 as illustrated by arrow 15.

Explosive 11 is provided with conductors 16 and 17 positioned on the explosive so that detonation wave 13 propagates through the explosive and between the conductors. Conductors 16 and 17 are positioned adjacent explosive 11 and between the explosive and any casing or other structure (not shown) which is used to support the explosive.

Conductor 16 is attached to high voltage lead 18 of an electrical pulser (not shown) while conductor 17 is connected at 19 to a ground common to the pulser. The pulser provides the necessary voltage and current required for a specific application and is discharged as detonation wave 13 proceeds through explosive 11 from first end 12 to end 14. The current flows through the conductive detonation wave and releases energy in the wave at a rate proportional to the product of the current and the electrical resistance within the steady state detonation wave.

The velocity and pressure in a detonation wave proceeding through the explosive material and the total work accomplished by hot, explosive product gases are determined by the chemical energy available in the explosive material for release. The input of electrical energy or other sources of energy into the detonation wave augments the chemical energy of the explosive and increases the velocity and pressure of the detonation wave.

In an explosive material the steady state detonation wave is more electrically conductive then either the unreacted explosive or the detonation product gases. The steady state region of the wave can be used as an effective load resistance for a source of electrical energy supplied by electrical generators, electrical pulsers or explosively driven electrical sources. The electrical energy is coupled directly into the detonation wave, adds energy over and above that released chemically and increases the detonation pressure and detonation velocity of the wave. Therefore, the total energy subsequently released by the explosive, will be in direct proportion to the electrical energy deposited. It is contemplated that other means for adding energy to the detonation wave can also be utilized as a power source such as LASER and MASER energy which can be used with explosives which are transparent to the radiation in either the unreacted and gaseous product states but for which the detonation wave is opaque and thus an absorber of the radiation.

Figure 2:
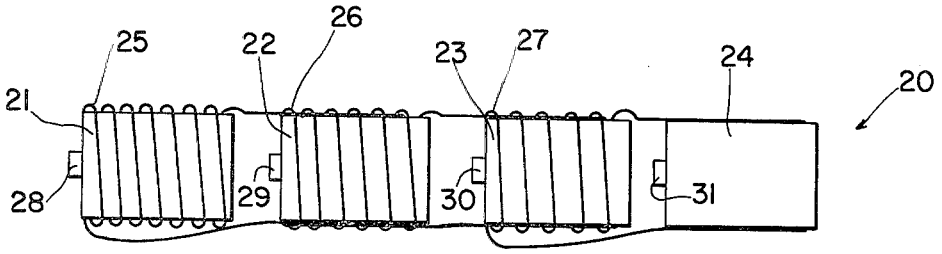
FIG. 2 is a schematic illustration of the invention as applied to sequential pulse power generators.

Referring to FIG. 2 there is illustrated a sequential, explosively driven pulse power generator 20 using the augmentation system of the subject invention. The generator has explosive charges 21, 22, 23, and 24 having detonators 28, 29, 30 and 31, respectively. Charges 21, 22 and 23 are provided with generating coils 25, 26, and 27, respectively. The generating coils are provided with leads 25*a*, 25*b*, 26*a*, 26*b*, 27*a*, 27*b*, respectively, which are disposed on opposite sides of the adjacent explosive charge. Generating coil 25 is wound around charge 21 and has leads 25*a* and 25*b* disposed on opposite sides of explosive charge 22, coil 26 is wound around charge 22 and has leads 26*a* and 26*b* disposed on opposite sides of explosive charge 23 and coil 27 is wound around charge 23 and has leads 27*a* and 27*b* disposed on opposite sides of charge 24.

In operation, a current is applied to the generating coils 25, 26 and 27 and explosive charges 21, 22, 23 and 24 are then detonated sequentially by their respective detonators. When explosive charge 21 is detonated, a detonation wave (not shown) moves down the charge, collapses the magnetic field created by coil 25 and generates a high current in coil 25. The current created in coil 25 is furnished by leads 25*a* and 25*b* to the detonation wave (not shown) created by detonation of explosive charge 22 thus augmenting the energy released by charge 22 and increasing the velocity and pressure of the wave.

As the increased detonation wave proceeds down explosive charge 22, the magnetic field created by coil 26 is collapsed and a high current is generated in coil 26. The current created in coil 26 is proportionally higher than that created by an unaugmented wave due to the increase in pressure and velocity of the detonation wave from the augmentation energy supplied by coil 25. The process is repeated as explosive charges 23 and 24 are sequentially detonated to result in the production of a detonation wave in charge 24 with increased velocity and pressure.

Although the preceding embodiments of the subject invention are illustrated using ribbon-shaped charges, it is to be understood that the augmentation system with suitable modifications can be applied to any shape of explosive charge, spherical, cylindrical, etc., or any form of shock wave where it is desired to increase the pressure and velocity of the wave.

It is apparent that the disclosed augmentation system provides for augmenting the chemical energy of an explosive charge beyond the chemical capabilities of the charge and increasing the velocity and pressure of a detonation wave passing through the charge. The augmentation system can be used in sequential, explosively driven pulse power generators to produce large power pulses by feeding the output of one generator into the detonation wave of the next generator.

Many obvious modifications and embodiments of the specific invention, other than those set forth above, will readily come to mind to one skilled in the art having the benefit of the teachings presented in the foregoing description and the accompanying drawings of the subject invention and hence it is to be understood that such modifications are included within the scope of the appended claims.

What is claimed as new and desired to be secured by Letters Patent of the United States is:

1. A device for increasing the energy from the detonation of an explosive, comprising:
- an explosive charge; and
- means adding energy to the detonation wave of the explosive charge;
- whereby upon detonation of the explosive charge the detonation wave passes through the charge and the means adding energy increases the velocity and pressure of the detonation wave.

2. A device as in claim 1 wherein the explosive charge is provided with detonation means.

3. A device for increasing the energy from the detonation of an explosive, comprising:
- an explosive charge;
- means detonating the charge; and
- means adding energy to the detonation wave of the explosive charge;
- whereby upon detonation of the explosive charge the detonation wave passes through the charge and the means adding energy increases the velocity and pressure of the detonation wave.

4. A device for increasing the energy of a shock wave passing through a medium, comprising
- means for initiating the wave in the medium; and
- means for adding energy to the wave;
- whereby upon initiation and passage of the wave through the medium the means for adding energy increases the velocity and pressure of the wave.

5. A device as in claims 2, 3 and 4 wherein the means adding energy comprises a source of power coupled to the explosive charge.

6. A device as in claim 5 wherein the source of power is an electric generator.

7. A device as in claim 5 wherein the source of power is a laser.

8. A device as in claim 5 wherein the source of power is a maser.

9. A method for increasing the energy from the detonation of an explosive charge, comprising:
- detonating the explosive charge to form a detonation wave; and
- adding energy to the detonation wave to increase the pressure and velocity of the wave.

10. A device as in claim 9 wherein the energy is added to the wave by a source of power coupled to the charge.

11. A device as in claim 10 wherein the source of power is an electric generator.

12. A device as in claim 10 wherein the source of power is a laser.

13. A device as in claim 10 wherein the source of power is a maser.

14. A device for increasing the energy released by adjacent sequential pulse power generators, each generator comprising:
- an explosive charge;
- means detonating the explosive charge;
- means generating current and coupled to the adjacent generator; and
- means applying initial current to the means generating current to form a magnetic field;
- whereby upon detonation of the explosive charge a detonation wave passes down the charge collapsing the magnetic field and creating a high current in the means generating current, said current being applied to the detonation wave in the adjacent generator so as to increase the velocity and pressure of the adjacent generator detonation wave thus increasing the current generated in the adjacent generator means generating current.

15. A device for augmenting the energy released by the detonation wave in an explosive, comprising:
- an explosive;
- means detonating the explosive to form a detonation wave;
- electrical conductors positioned adjacent the explosive; and
- means supplying energy to the conductors and detonation wave as the wave passes through the explosive so as to increase the velocity and pressure of the wave.

* * * * *